US010082334B2

(12) United States Patent
Pallmann

(10) Patent No.: US 10,082,334 B2
(45) Date of Patent: Sep. 25, 2018

(54) DEVICE FOR BIOMASS BENEFICIATION, IN PARTICULAR FOR THE MECHANICAL DRYING OF PLANT BIOMASS

(71) Applicant: PALLMANN MASCHINENFABRIK GmbH & Co. KG, Zweibruecken (DE)

(72) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 358 days.

(21) Appl. No.: 15/153,058

(22) Filed: May 12, 2016

(65) Prior Publication Data

US 2016/0334160 A1 Nov. 17, 2016

(30) Foreign Application Priority Data

May 12, 2015 (DE) ..... 10 2015 006 044

(51) Int. Cl.
*F26B 5/14* (2006.01)
*B30B 9/06* (2006.01)
*F26B 17/12* (2006.01)

(52) U.S. Cl.
CPC ..... *F26B 5/14* (2013.01); *B30B 9/06* (2013.01); *B30B 9/067* (2013.01); *F26B 17/12* (2013.01); *F26B 2200/02* (2013.01); *F26B 2200/24* (2013.01); *F26B 2210/16* (2013.01)

(58) Field of Classification Search
CPC ..... F26B 5/14; F26B 13/28; F26B 2210/04; F26B 2200/24; F26B 2200/02
USPC ..... 34/398, 397, 576, 580, 583, 64, 174
See application file for complete search history.

(56) References Cited

U.S. PATENT DOCUMENTS

2006/0162181 A1* 7/2006 La Gioia ..... B30B 9/06 34/397

FOREIGN PATENT DOCUMENTS

DE 93 05 023 U1 7/1993

* cited by examiner

*Primary Examiner* — John McCormack
(74) *Attorney, Agent, or Firm* — Muncy, Geissler, Olds & Lowe, P.C.

(57) ABSTRACT

A device for biomass beneficiation, in particular for the mechanical drying of plant biomass. The device has a press chamber, which can be supplied with biomass via a feed chute and can be emptied via a feedstock outlet. A pressure plate, which for compacting the biomass can be moved by a feed unit against the front wall of the press chamber, the wall lying opposite to the pressure plate, is disposed in the press chamber. In addition, the device has conveys away the liquid phase coming out of the biomass during the compaction. A first pivot bearing, relative to the direction of biomass movement, is provided on which the pressure plate is mounted with its first edge, and a second pivot bearing, on which the pressure plate is mounted with its second edge opposite the first edge, whereby at least the first pivot bearing is movable transverse to the plane of the pressure plate.

12 Claims, 3 Drawing Sheets

DEVICE FOR BIOMASS BENEFICIATION, IN PARTICULAR FOR THE MECHANICAL DRYING OF PLANT BIOMASS

This nonprovisional application claims priority under 35 U.S.C. § 119(a) to German Patent Application No. 10 2015 006 044.9, which was filed in Germany on May 12, 2015, and which is herein incorporated by reference.

BACKGROUND OF THE INVENTION

Field of the Invention

The invention relates to a device for biomass beneficiation.

Description of the Background Art

In the industrial processing of substances of plant origin, by-products are usually formed which are often disposed of as waste or utilized thermally. The forestry sector and the timber industry can be cited by way of example where by-products such as, for example, bark, branches, flitches, wood chips, sawdust, and the like arise during logging or wood-processing processes. Many of these by-products can be used as material for the production of semi finished products such as particle boards, but a large portion is utilized thermally as bioenergy sources in the form of wood chips and pellets, whereby substances still contained in the by-products are unused. This also applies to other types of biomass such as, for example, fruit, sugar cane and sugar beets, palm, and the like.

SUMMARY OF THE INVENTION

It is therefore an object of the invention to beneficiate the biomass further, as it arises as a by-product in production processes, in order to better utilize the value added potential of the biomass.

An embodiment of the invention separate as much as possible the liquid phase present in the biomass by mechanical compaction of the biomass. As a result, the inherent moisture content of the biomass is reduced, which simultaneously causes an increase in the heating value. This proves to be a great advantage primarily in a subsequent thermal utilization of the beneficiated solid phase. The liquid phase coming out of the biomass during the compaction is collected for further beneficiation, whereby the many substances contained therein can be used depending on their material composition for the respective specific purposes. The liquid phase of the biomass is made usable in this way for the first time as a recoverable material.

Compared with devices that only beneficiate the biomass thermally, therefore, a device of the invention succeeds in more effectively tapping the potential inherent in the biomass. At the same time, a device of the invention is notable for a more rapid and more cost-effective type of beneficiation, which constitutes a decisive economic advantage over known devices.

It is characteristic for a device of the invention that hardly any heat is introduced into the biomass during the beneficiation. This property expands the field of application of a device of the invention to heat-sensitive biomass as well.

In an embodiment of the invention, the first pivot bearing for compacting the biomass is made movable and the second pivot bearing is made to be stationary. In contrast, however, an embodiment with two movable pivot bearings is preferred. It is possible thereby to move the pressure plate also in a translational manner in the press chamber, so that a uniform pressing can be exerted on the biomass over the entire pressure surface of the pressure plate.

The advance of the pressure plate can be achieved with hydraulically driven cylinder-piston units, with which high advance forces can be produced with a finely differentiated control. If a hydraulic cylinder-piston unit is also use for advancing the bottom pivot bearing, then the first and second cylinder-piston unit can jointly use the components of the hydraulic drive and control, which increases the efficiency of the invention. Apart from hydraulic drives, mechanical drives such as, for example, spindle drives also fall within the scope of the invention.

According to an embodiment of the invention, the first cylinder-piston unit and second cylinder-piston unit can be actuated independently of one another. This opens the possibility of subjecting the pressure plate to different motion sequences during the biomass compacting movement; these sequences range from a pure translational movement or a pure pivoting movement up to any overlapping of translational and pivoting movements. It is thereby possible to adapt the type of beneficiation to the particular properties of the biomass. However, the pressure plate can be brought into a position advantageous for the maintenance staff for maintenance and repair work as well.

The pressure plate during feedstock beneficiation can press the biomass against a perforated die. Short flow paths for the liquid phase contained in the biomass can be achieved in this way. The liquid phase is separated very rapidly and extremely efficiently from the biomass in this way. If the perforated die were to become clogged during feedstock beneficiation, it can be replaced by another one without a great amount of work and time in order to resume operation.

These advantages have a greater impact, if in a refinement of the invention the liquid phase is collected and conveyed away in a channel system in the front wall of the press chamber. The effect of the compaction of the biomass on its flow resistance is minimized further thereby.

According to embodiment of the invention, the first cylinder-piston unit can be set back in the direction of the back wall relative to the second cylinder-piston unit. This results in greater flexibility in the movement control of the pressure plate in the press chamber intake area and in this way said plate can be moved relatively far in the direction of the back wall.

In order not the limit the work area of the pressure plate in the sphere of action of the first cylinder-piston unit, the first cylinder-piston unit can have a greater piston stroke than the second cylinder-piston unit.

In an embodiment of the invention, the feedstock inlet and/or feedstock outlet open directly into the press chamber in the area of the front wall or optionally in the area of the perforated die. In this way the biomass is brought directly into the sphere of action between the perforated die and pressure plate, which results in short travel distances for the pressure plate and thereby short cycle times.

In an embodiment of the invention, the pressure plate based on the direction of biomass movement has different pressure surface areas each with a different inclination relative to the front wall of the press chamber, in order to influence the movement of the biomass during the compaction by the pressure plate. For example, the first area of the pressure surface can be inclined more greatly toward the front wall in order to counter movement of the biomass back into the feedstock inlet during the compaction. It is likewise possible to incline the pressure surface edge region associated with the feedstock outlet toward the back wall in order to create a flow channel there for the biomass together with the front wall or optionally with the perforated die.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
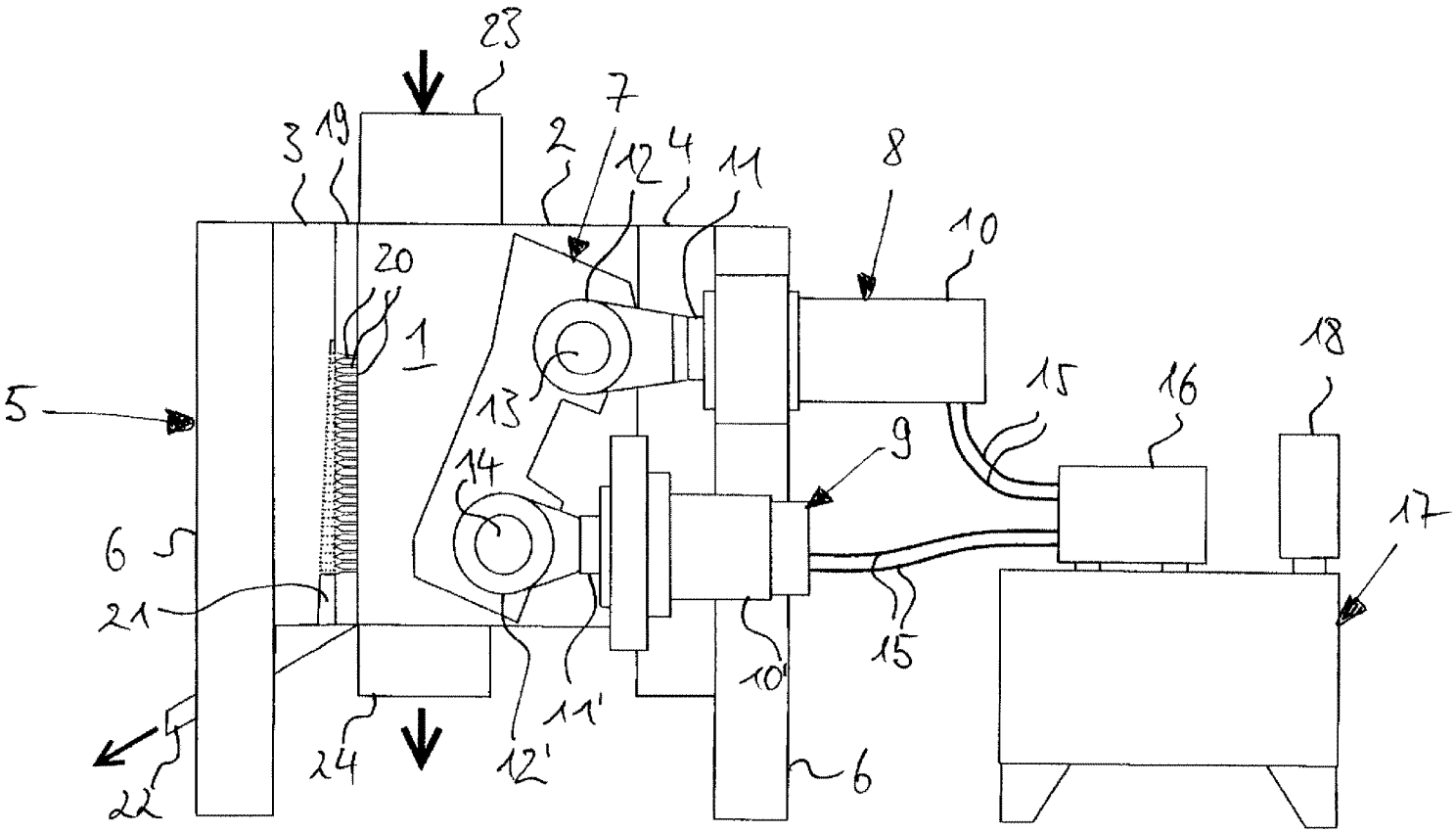
FIG. 1 is a schematic illustration that shows a cross-sectional view through a first embodiment of a device of the invention.
Figure 2:
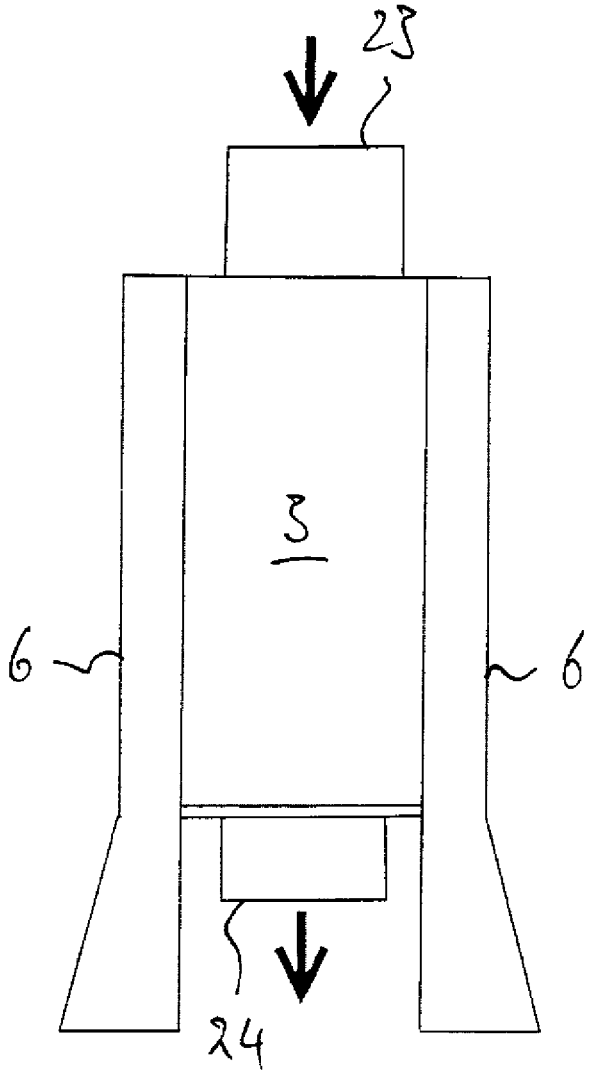
FIG. 2 shows a front view of the device illustrated in FIG. 1.

FIGS. 1 and 2 show a first embodiment of the invention in which the biomass flows through the device substantially vertically from the top to the bottom. The device has a cylindrical press chamber 1 formed by two side walls 2; said side walls run plane-parallel to the plane of the illustration at a mutual clearance to one another and at their side ends are connected to one another by a front wall 3 and a back wall 4. Side walls 2, front wall 3, and back wall 4 are retained in a machine base frame 5, which is supported by vertical supports 6 on the ground.

A pressure plate 7 is disposed movable in the horizontal direction within press chamber 1; said plate extends from the one side wall 2 to the opposite side wall and the pressure surface thereof facing press chamber 1 is opposite to front wall 3 in the clearance. In the top region, the pressure surface is inclined relative to the middle region in the direction of press chamber 1, but in the bottom edge region in contrast in the direction of back wall 4. At the rear side of pressure plate 7, said side facing away from the pressure surface, a top pivot bearing with a horizontal top bearing axis 13 can be seen in the top edge region and below this a bottom pivot bearing, situated in the bottom edge region, with a horizontal bottom bearing axis 14.

The device of the invention comprises further a top cylinder-piston unit 8 and a bottom cylinder-piston unit 9 disposed axis-parallel thereto. The two cylinder-piston units 8 and 9 are anchored rigidly with their cylinders 10, 10' in back wall 4, whereby top cylinder 10 is set back relative to bottom cylinder 10' and has a greater piston stroke compared with bottom piston 11'. The parallel, movable pistons 11, 11' of cylinder-piston units 8 and 9 are connected in an articulated manner to the pivot bearing at the rear side of pressure plate 7, for which purpose movable pistons 11, 11' at their free end each have a bearing eye 12, 12', which sits rotatably on top pivot axis 13 or bottom pivot axis 14. In a synchronously running piston stroke of the two cylinder-piston units 8 and 9, pressure plate 7 executes a translational movement, in the case of a different piston stroke a pure pivoting movement or a combination of translational and pivoting movements.

Cylinder-piston units 8 and 9 are connected via pressure lines 15 to a pump 16 of a hydraulic unit 17, to which control unit 18 as well is attached for controlling the device. The two cylinder-piston units 8 and 9 can be controlled independently of one another.

A perforated die 19 with a plurality of horizontal through-openings 20 lies over a large area against the side, facing press chamber 1, of front wall 3. In the area of through-openings 20, front wall 3 has a number of channels 21, which run vertically and parallel to one another and whose depth increases in the direction of the bottom edge of front wall 3. An outlet 22 running transversally downward is connected to channels 21.

To feed press chamber 1 with biomass, a feed chute 23 through which the biomass reaches press chamber 1 is provided at the top side of the device. The device has a feedstock outlet 24 at the opposite bottom side. Feedstock inlet 23 and feedstock outlet 24 are disposed aligned to one another and open directly into press chamber 1 in the area in front of perforated die 19. The material flow through a device of the invention therefore is substantially straight from top to bottom along perforated die 19.

For the intended use, a device of the invention is first brought into a starting position for an operating cycle by moving piston 11 of top cylinder-piston unit 8, for example, into top cylinder 10; optionally in this case piston 11' of bottom cylinder-piston unit 9 can also be moved out of cylinder 10'. As a result, pressure plate 7 reaches a slanted position in which the bottom edge of pressure plate 7 makes the available flow cross section in press chamber 1 narrower, while the top edge lies outside the cross section of feed chute 23. In this position of pressure plate 7 the device is supplied with biomass which fills the free space between side walls 2, perforated die 19, and pressure plate 7.

Then a first compaction of the feedstock occurs by extending piston 11 of top cylinder-piston unit 8, whereas the position of piston 11' of bottom cylinder-piston unit 9 remains unchanged. As a result, pressure plate 7 pivots about bottom pivot axis 14. As soon as pressure plate 7 has assumed an approximately plane-parallel position to perforated die 19, both cylinder-piston units 8 and 9 are operated in parallel, which has the result that a residual compaction of the biomass is brought about due to the starting parallel movement of pressure plate 7 in the direction of perforated die 19.

The liquid phase, coming out of the biomass during the increasing compaction, reaches the rear side of perforated die 19 through through-openings 20, where it is collected in channels 21 and conveyed to outlet 22. The solid phase, in contrast, leaves the device via feedstock outlet 24, after pressure plate 7 has been moved in the direction of back wall 4 by retraction of both pistons 11, 11' of cylinder-piston units 8 and 9.

Figure 3:
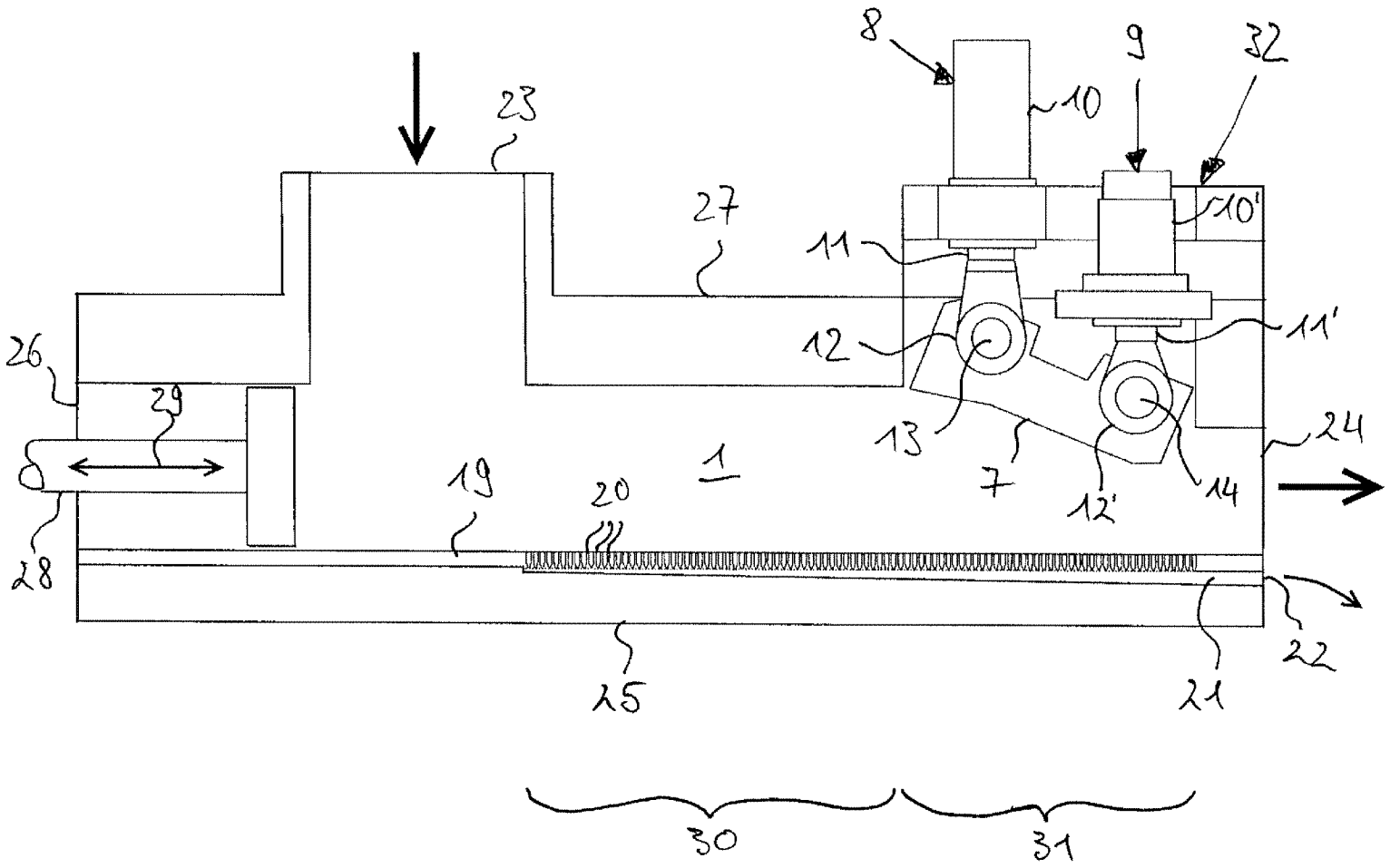
FIG. 3 shows in a schematic illustration a cross-sectional view through a second embodiment of a device of the invention.

FIG. 3 shows an embodiment of the invention with horizontal material flow. The horizontally extending cylindrical press chamber 1 is formed by a bottom wall 25, two plane-parallel side walls 26, and a top wall 27. At the end region of press chamber 1, said region being the right end region in the drawing, a vertical feed chute 23 can be seen which opens into press chamber 1. A piston-like conveying element 28, which can be moved back and forth in press chamber 1 according to double arrow 29, is disposed in the axial extension of press chamber 1, beyond feed chute 23.

Downstream of feed chute 23, there is first a cylindrical press chamber section 30 with a precompaction function, which is then followed by a region 31 where the final compaction occurs. A compacter unit 32, which corresponds substantially to the unit described in FIGS. 1 and 2, is disposed in region 31 of the final compaction. Compacter unit 32 has, based on the material flow, a first cylinder-piston unit 8 and second cylinder-piston unit 9, whose movable pistons 11, 11' bear a pressure plate 7, as described for FIGS. 1 and 2. Pressure plate 7 can be pivoted into press chamber 1 and/or moved plane-parallel by the individual control of cylinder-piston units 8 and 9, in order to narrow or widen the cross section of press chamber 1. Feedstock outlet 24 is connected to region 31.

A perforated die 19 is disposed again on the side, facing press chamber 1, of bottom wall 25; in section 30 of the precompaction and section 31 of the final compaction, the die has a plurality of through-openings 20, which on the rear side of perforated die 19 open into a number of axis-parallel channels 21 on the top side of bottom wall 25. Channels 21 have an increasing depth in the direction of the material flow and at the end of the device form an outlet 22 for the liquid phase of the biomass.

During operation, the device of the invention is supplied continuously with biomass via feed chute 23; the biomass is then pushed by the oscillating conveying element 28 into the area of cylindrical section 30 of press chamber 1. In so doing, the biomass undergoes a first compaction in which liquid coming out of the material is removed out of the device via perforated die 19 and channels 21.

The thus precompacted biomass is pushed forward by the following feedstock into region 31 of the final compaction, where it is compacted in sections with great force by pressure plate 7. The operation of pressure plate 7 has already been described in regard to FIGS. 1 and 2, so that the statements made there apply accordingly.

It is possible alternatively to use pressure plate 7 as a stationary narrowing of the cross section, the position of which no longer changes after it has been set to a predefined press gap with perforated die 19. The biomass in this case is compressed continuously during passage through the press gap, whereby the residual fluid present in the biomass is removed in the described manner.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for biomass beneficiation for the mechanical drying of plant biomass, the device comprising:

a press chamber that is suppliable with biomass via a feed chute and is emptied via a feedstock outlet;

a pressure plate, which for compacting the biomass is movable via a feed unit arranged against a front wall of the press chamber, the front wall lying opposite to the pressure plate, the pressure plate being disposed in the press chamber;

a conveyor for conveying away the liquid phase coming out of the biomass during compaction;

a first pivot bearing, arranged in a direction of biomass movement, on which the pressure plate is mounted with its first edge; and a second pivot bearing on which the pressure plate is mounted with its second edge opposite the first edge, wherein at least the first pivot bearing is movable transverse to the plane of the pressure plate.

2. The device according to claim 1, wherein the second pivot bearing is movable transverse to the plane of the pressure plate.

3. The device according to claim 1, wherein the feed unit comprises a first cylinder-piston unit, based on the direction of biomass movement, whose movable piston is pivoted on the first pivot bearing.

4. The device according to claim 3, wherein the feed unit comprises a second cylinder-piston unit, based on the direction of biomass movement, whose movable piston is pivoted on the second pivot bearing.

5. The device according to claim 4, wherein the first cylinder-piston unit and the second cylinder-piston unit are actuatable independently of one another.

6. The device according to claim 1, wherein the conveyor for removing the liquid phase of the biomass comprise a perforated die having through-openings and is disposed on a side, facing the press chamber of the front wall.

7. The device according to claim 1, wherein the conveyor for removing the liquid phase of the biomass comprise at least one open channel on the side, facing the press chamber, of the front wall.

8. The device according to claim 4, wherein the first cylinder-piston unit is set back from the press chamber in a direction of the back wall relative to the second cylinder-piston unit.

9. The device according to claim 4, wherein the first cylinder-piston unit has a greater piston stroke compared with the second cylinder-piston unit.

10. The device according to claim 1, wherein a feedstock inlet opens directly in the press chamber in an area of the front wall or a perforated die.

11. The device according to claim 1, wherein the feedstock outlet opens directly from the press chamber in an area of the front wall or a perforated die.

12. The device according to claim 1, wherein the pressure surface, facing the press chamber, of the pressure plate, based on the direction of biomass movement, has different areas with different inclinations relative to the front wall.

* * * * *